United States Patent [19]

Judd

[11] 3,933,304

[45] Jan. 20, 1976

[54] BAGS FOR CONTAINING BANK NOTES

[75] Inventor: William James Judd, London, England

[73] Assignee: Decoflex Limited, England

[22] Filed: Feb. 22, 1974

[21] Appl. No.: 444,903

[52] U.S. Cl. ..... 229/62; 206/807
[51] Int. Cl.[2] ..... B65D 33/34
[58] Field of Search ..... 229/62, 80, 83; 206/807

[56] References Cited

UNITED STATES PATENTS

| | | | |
|---|---|---|---|
| 1,201,519 | 10/1916 | Sorensen | 229/83 X |
| 2,181,252 | 11/1939 | Vogel | 229/80 |
| 3,809,217 | 5/1974 | Harrison | 229/83 X |

FOREIGN PATENTS OR APPLICATIONS

| | | |
|---|---|---|
| 1,136,261 | 12/1968 | United Kingdom |

*Primary Examiner*—William T. Dixson, Jr.
*Assistant Examiner*—Stephen P. Garbe
*Attorney, Agent, or Firm*—Watson, Cole, Grindle & Watson

[57] ABSTRACT

This invention concerns bags suitable for containing bank notes. The bag is made of synthic plastics material and bears a label to receive information about the number of notes and a description of the notes contained or to be contained in the bag. Areas of printing are arranged at each opposite end of the bag so that when the bag is sealed at the ends near the areas of printing the bag connot be opened and the notes extracted from the bag without at least one of the areas of printing being mutilated and the attempt to tamper with the bag being apparent.

1 Claim, 3 Drawing Figures

BAGS FOR CONTAINING BANK NOTES

This invention relates to a bag for containing bank notes.

In commercial banking, where a branch has bank notes in excess of their requirements, the notes are packaged and returned to a central depot for redistribution. Also where a bank has notes that they consider unfit for reissue, these too are packaged and returned to a destruction center.

In both cases the currency is still valid and, therefore, it is necessary to ensure that notes are not withdrawn from packages during transit.

One type of bag which has been used for containing bank notes is described in British Patent Specification No. 1,132,419 the bag being elongated and made of transparent plastics material. When the bag has been filled with bank notes, the cashier initials a label which is irremovably attached to the outside of the bag and heat seals the bag along the open end. The label is either irremovably attached to the outside of the bag or is printed thereon in facsimile form with a special ink which is receptive to writing and which is difficult to remove.

An object of the present invention is to provide an improved bag for containing bank notes.

According to the present invention there is provided a bag for containing bank notes, the bag being of synthetic plastics material and having areas of printing at opposite ends thereof respectively so that when the bag is sealed at the opposite ends adjacent to and between the areas of printing the bag cannot be opened and notes extracted and the bag then resealed without at least one of the areas of printing being mutilated and the attempt to tamper with the bag being made apparent.

If the bag is tampered with, at least one of the areas of printing, called security printing, is mutilated or destroyed such as by removal of the printing. If the bag is cut inside the seal area so as to open the bag, the area of printing is removed. Since the seals are located immediately adjacent to the security printing and not within the area of the printing there is no possibility of making a fresh seal at either end without the fact being obvious due to the absence of security printing.

An example of a bag for containing bank notes according to the present invention will now be described with reference to drawings, in which.

Figure 1:
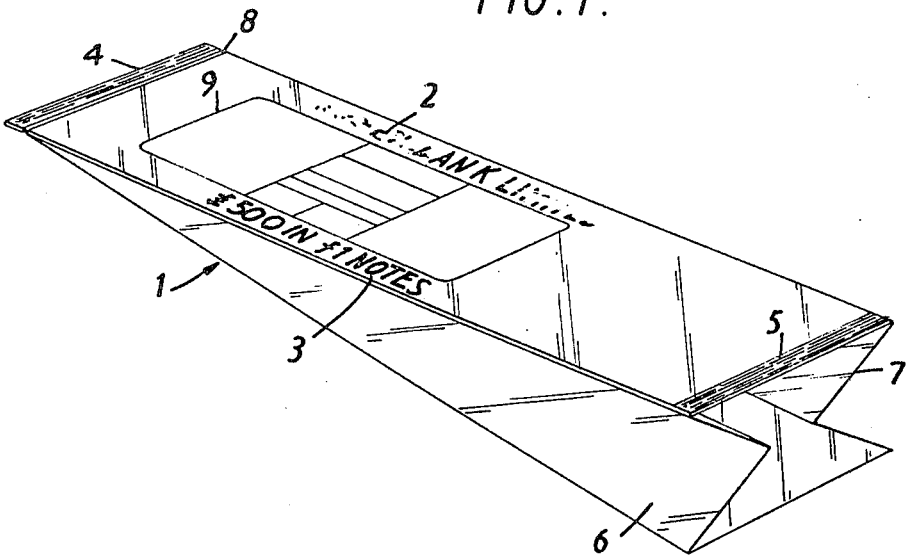
FIG. 1 is a perspective view of the bag which is in an open condition prior to the insertion of bank notes.
Figure 2:
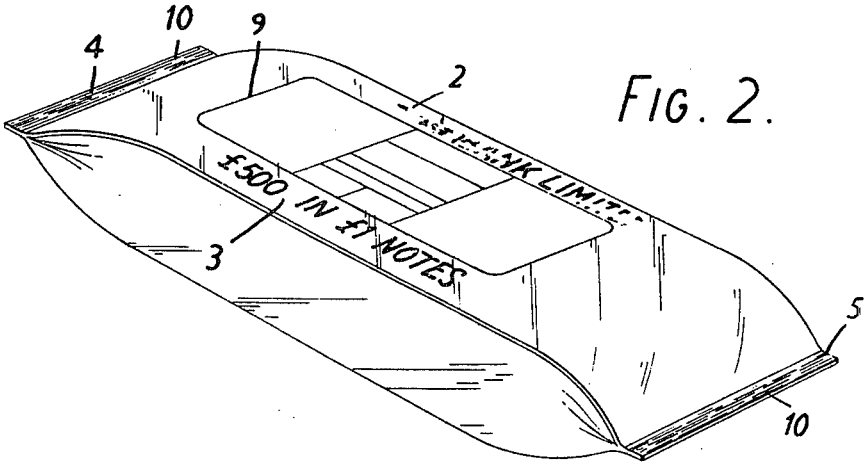
FIG. 2 is a perspective view of the bag containing bank notes and which has been sealed.
Figure 3:
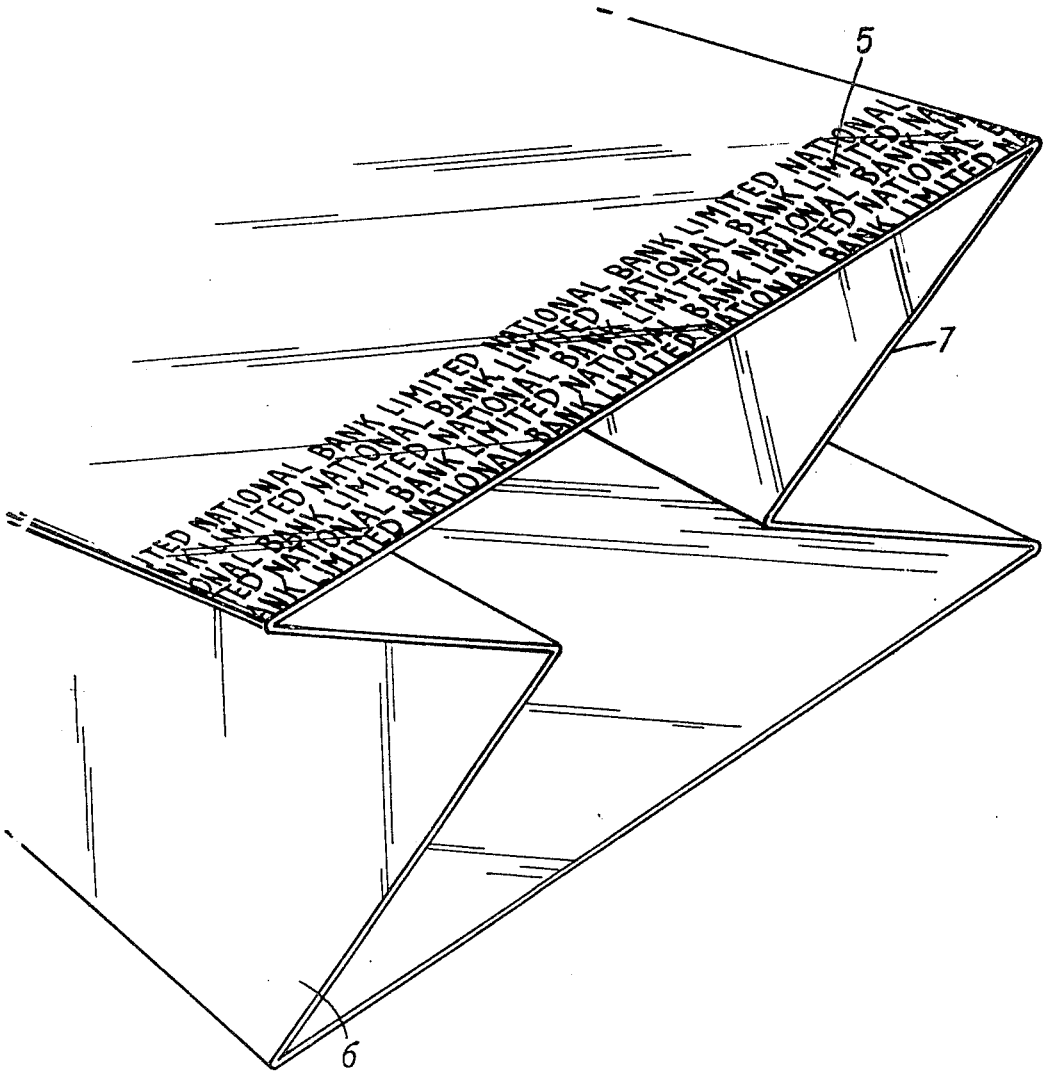
FIG. 3 is a fragmentary perspective, on a larger scale, of the open end of the bag of FIG. 1.

The bag, generally designated 1, is cut, for example from 200 gauge seamless polyethylene tubing which has been preprinted at 2 with the name of the bank which will use the bag, at 3 with the number and denomination of notes which are to be inserted into the bag and at 4 and 5 with areas of security printing. These areas of security printing consist of the name of the bank repeatedly printed with the name form being spread across the bag and in lines all in close juxtaposition. This is sometimes referred to as micro-printing. The tube may be provided with gussets 6 and 7. The bag is heat sealed at one end 8 immediately adjacent to the area of micro-printing at that end of the bag — and between the micro-printing and the other end of the bag which remains open. An adhesive label 9 is irremovably attached to the transparent material before the material is cut into bag lengths as described in British Patent Specification No. 1,136,261. Alternatively, the label 9 may be printed on the bag in facsimile form with a special ink which is receptive to writing and which is difficult to remove.

In operation, a cashier at a bank opens the bag 1 by pulling apart the open ends of the bag so that the bag is in the condition shown in FIG. 1. Bank notes are then inserted into the bag and the cashier writes his signature on the label 9 together with other information as to the contents of the bag, if necessary.

The open end of the bag is then closed and is inserted into apparatus for heat sealing the open end or mouth at 10. This seal is located immediately adjacent to the area of the security micro-printing at the end of the bag and between the two areas of micro-printing.

The sealing apparatus may be arranged to print and/or emboss the mouth of the bag with the branch number of the bank.

It will be appreciated that the printed areas 4 and 5 at each end of the bag 1 discourages the opening and resealing of the bag because this cannot be done without mutilating or destroying the print. If any attempt were made to open or tamper with the bag the fact would be immediately apparent.

Furthermore, it would not be possible for the operator to cut off the end of the bag and to re-seal it without detection. In this case there would be no micro-printing at that end of the bag and it would be obvious that the bag had been tampered with. Similarily, the cut-off end of the bag cannot be resealed to the bag without the fact being immediately apparent.

What I claim is:

1. A container for containing slips of paper, the container comprising an elongated bag made of a synthetic plastic material, said bag having: two longitudinal end portions, each bearing an area of printing, said areas of printing extending transversely to the longitudinal axis of said bag; a first heat seal located between said area of printing at one said longitudinal end portion of said bag and the center of said bag, at a position immediately adjacent to such area of printing; and said bag being adapted to be heat sealed at a second location between said area of printing at the other said longitudinal end portion of said bag and the center of said bag, at a position immediately adjacent such area of printing; whereby after slips of paper have been inserted within the bag and the heat seal at said second location formed, any tampering with said bag would be readily visibly apparent.

* * * * *